US006752558B1

(12) United States Patent
Hsu

(10) Patent No.: US 6,752,558 B1
(45) Date of Patent: Jun. 22, 2004

(54) LIQUID LIPSTICK DISPENSING DEVICE

(76) Inventor: Kuo Sung Hsu, No. 24, Array 43, Lane 344, Chung Cheng S. Road, Yung Kang, Tainan (TW), 710

( * ) Notice: Subject to any disclaimer, the term of this patent is extended or adjusted under 35 U.S.C. 154(b) by 0 days.

(21) Appl. No.: 10/397,898

(22) Filed: Mar. 26, 2003

(51) Int. Cl.[7] ..... A46B 11/04; B43K 5/06

(52) U.S. Cl. ..... 401/270; 401/173; 401/172; 401/286

(58) Field of Search ..... 401/270, 173, 401/172, 171, 286, 288, 277, 75, 76, 77

(56) References Cited

U.S. PATENT DOCUMENTS 1,188,214 A * 6/1916 Sohn ..... 222/242
1,340,043 A * 5/1920 Grace ..... 222/390
2,009,761 A * 7/1935 Calderara ..... 222/92
4,277,194 A * 7/1981 Smith ..... 401/173
6,155,735 A * 12/2000 Nakajima ..... 401/172

* cited by examiner

*Primary Examiner*—David J Walczak
(74) *Attorney, Agent, or Firm*—Charles E. Baxley

(57) ABSTRACT

A liquid lipstick dispensing device includes a housing to receive liquid or pasty lipstick material, a mouth attached to one end of the housing, a piston slidably received in the housing to force the lipstick material out of the housing, and a duct disposed in the housing. A shank is attached to the piston, to move the piston relative to the housing and to force the lipstick material out of the housing. The shank is threaded to the duct, to move the shank longitudinally along the housing when the shank is rotated relative to the duct and the housing. A device may be used to prevent the shank from rotating reversely relative to the housing.

11 Claims, 4 Drawing Sheets

LIQUID LIPSTICK DISPENSING DEVICE

BACKGROUND OF THE INVENTION

1. Field of the Invention

The present invention relates to a lipstick dispensing device, and more particularly to a liquid lipstick dispensing device for evenly dispensing the liquid-state or pasty-like lipstick.

2. Description of the Prior Art

Typical lipsticks normally comprise a solid and bar-shaped lipstick retractably received in a housing, and extendible out of the housing by rotating a knob or the like, with such as a helical-moving structure, and receivable into the housing also by rotating a knob or the like.

The other typical lipstick devices comprise a liquid-state, or pasty-like lipstick material received within a container, and comprise a cap for enclosing the container, in order to enclose the container, and to retain the liquid-state, or pasty-like lipstick material within the container.

Normally, the cap may include a brush attached thereto, and engage able into the container to engage with the liquid-state, or pasty-like lipstick material, and to fetch or obtain or remove the liquid-state, or pasty-like lipstick material out of the container, and to apply onto the lips of the users.

However, the brush of the cap may normally fetch too much liquid-state, or pasty-like lipstick material, or little liquid-state, or pasty-like lipstick material, and may not be used to fetch a suitable quantity of the lipstick material.

The present invention has arisen to mitigate and/or obviate the afore-described disadvantages of the conventional liquid lipstick devices.

SUMMARY OF THE INVENTION

The primary objective of the present invention is to provide a liquid lipstick dispensing device for evenly dispensing the liquid-state or pasty-like lipstick.

In accordance with one aspect of the invention, there is provided a liquid lipstick dispensing device comprising a housing including a chamber formed therein to receive lipstick material therein, and including a lower portion and an upper portion, a mouth attached to the lower portion of the housing, to receive the lipstick material and to allow the lipstick material to flow out of the housing via the mouth, a piston slid ably received in the chamber of the housing and engaged with the lipstick material, to force the lipstick material to flow out of the housing, a shank including a first end attached to the piston, to move the piston relative to the housing and against the lipstick material, the shank including an outer portion having an outer thread formed thereon, a duct disposed in the housing, and including an inner thread formed therein and engaged with the outer thread of the shank, to cause the shank to move longitudinally along the housing when the shank is rotated relative to the duct and the housing, and a barrel secured to the shank, to rotate the shank relative to the duct and the housing. The piston may thus be gradually force to move relative to the housing, in order to evenly force the lipstick material out of the mouth.

The mouth includes an upper end having a plate attached thereto, the plate includes an orifice formed therein to allow the lipstick material to flow into the mouth and thus to flow out of the housing via the mouth.

The mouth further includes a lid secured to the plate and received in the mouth. The mouth includes a tube secured to the plate and received in the mouth, to define the orifice of the plate.

The mouth further includes a brush device disposed therein, and having a brush member extended out of the mouth. The brush device includes a panel received in the mouth, and having an aperture formed therein to receive the tube. The brush device includes a free end engaged within the brush member.

The housing includes a plurality of depressions formed therein, the duct includes an outer peripheral portion having at least one protrusion extended therefrom, to engage into either of the depressions of the housing, to prevent the duct from being rotated relative to the housing.

The shank includes at least one slot formed therein, the barrel includes at least one rib extended therefrom, and engaged into the slot of the shank, to secure the shank to the barrel, and to allow the shank to be rotated in concert with the barrel.

A device may further be provided to prevent the barrel from being rotated reversely relative to the housing, and includes a plurality of swellings provided in the duct, and a sleeve attached to the barrel and having at least one tooth engageable with the swellings of the duct, to prevent the barrel from being rotated reversely relative to the housing.

The duct includes an inner peripheral shoulder formed therein, and the swellings are extended from the inner peripheral shoulder of the duct. The barrel includes a plurality of grooves formed therein, and the sleeve includes an outer peripheral having at least one protrusion extended therefrom and engaged with either of the grooves of the barrel, to prevent the sleeve from rotating relative to the barrel.

A spring biasing device may further be provided to bias the tooth of the sleeve to engage with the swellings of the duct, and to prevent the barrel from being rotated reversely relative to the housing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
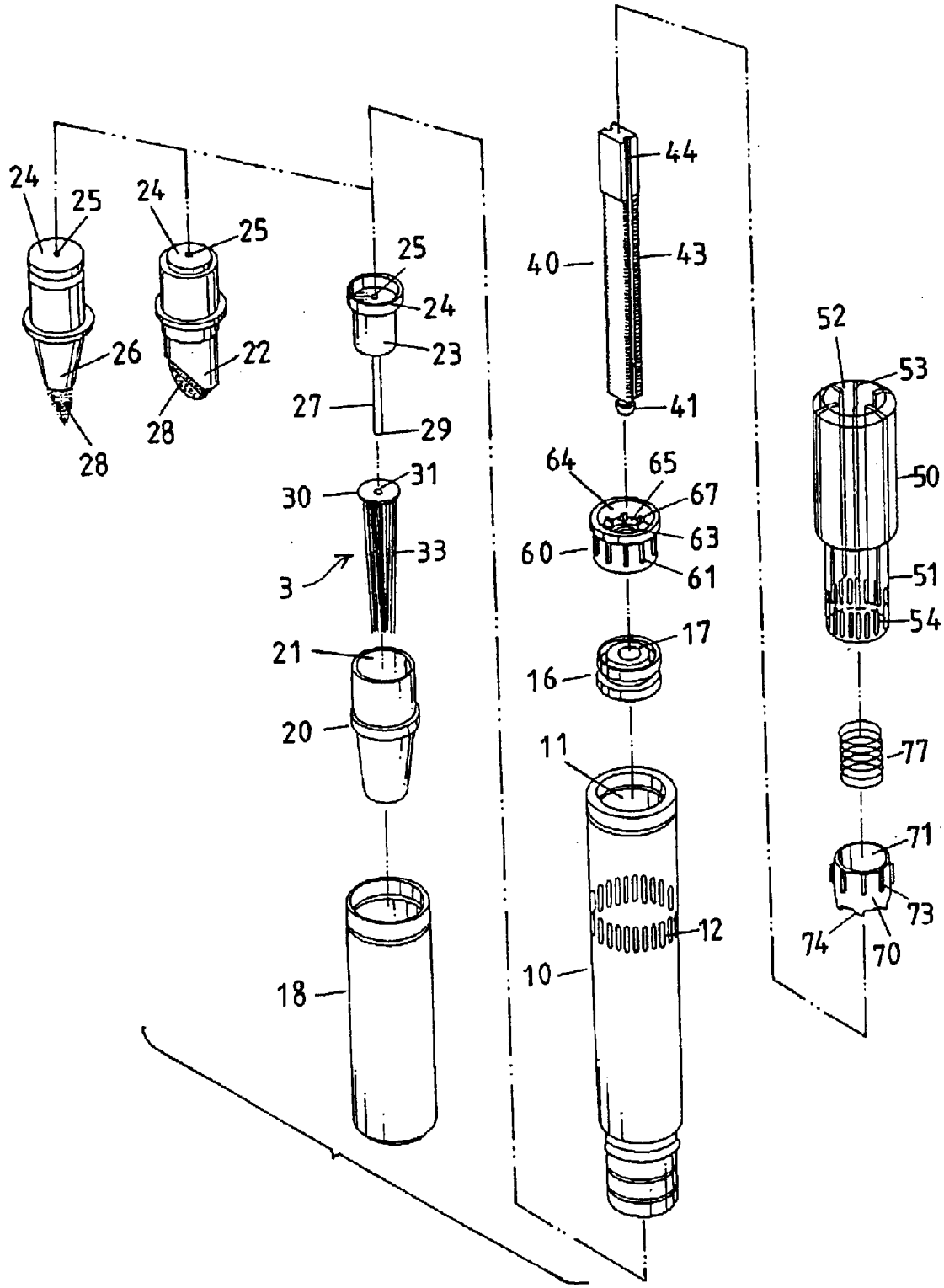
FIG. 1 is an exploded view of a liquid lipstick dispensing device in accordance with the present invention.

Referring to the drawings, and initially to FIGS. 1–4, a liquid lipstick dispensing device in accordance with the present invention comprises a housing 10 including a chamber 11 formed therein for receiving liquid-state, or pasty-like lipstick material 14 therein, and including one or more protrusions or depressions 12 formed therein, such as formed in the inner and middle portion thereof.

A plug or piston 16 is slidably engaged in the chamber 11 of the housing 10, and engaged on the liquid-state, or pasty-like lipstick material 14, for forcing the liquid-state, or pasty-like lipstick material 14 out of the housing 10. The piston 16 includes a cavity 17 formed in the upper portion thereof.

A mouth 20 is attached to the lower portion of the housing 10, and includes a bore 21 formed therein for receiving the liquid-state, or pasty-like lipstick material 14, and for allowing the liquid-state, or pasty-like lipstick material 14 to flow out of the housing 10 through the mouth 20.

A lid 23 is engaged in the upper portion of the bore 21 of the mouth 20, and includes an upper plate 24 engaged or secured on top of the mouth 20, and includes an orifice 25 formed therein, and a tube 27 extended therein to form or define the orifice 25 thereof. The liquid-state, or pasty-like lipstick material 14 may thus be forced to flow out through the orifice 25 of the tube 27.

The plate 24 may also be formed as a one-integral piece with the mouth 20 by such as welding processes, such as the mouths 22, 26 as shown in FIG. 1. A brush device 3 may be received in the mouth 20, and may include an upper panel 30 secured to the bottom portion of the lid 23. The panel 30 includes an aperture 31 formed therein to receive the tube 27 there through, and a brush member 33 attached thereto and engaged around the tube 27.

Figure 2:
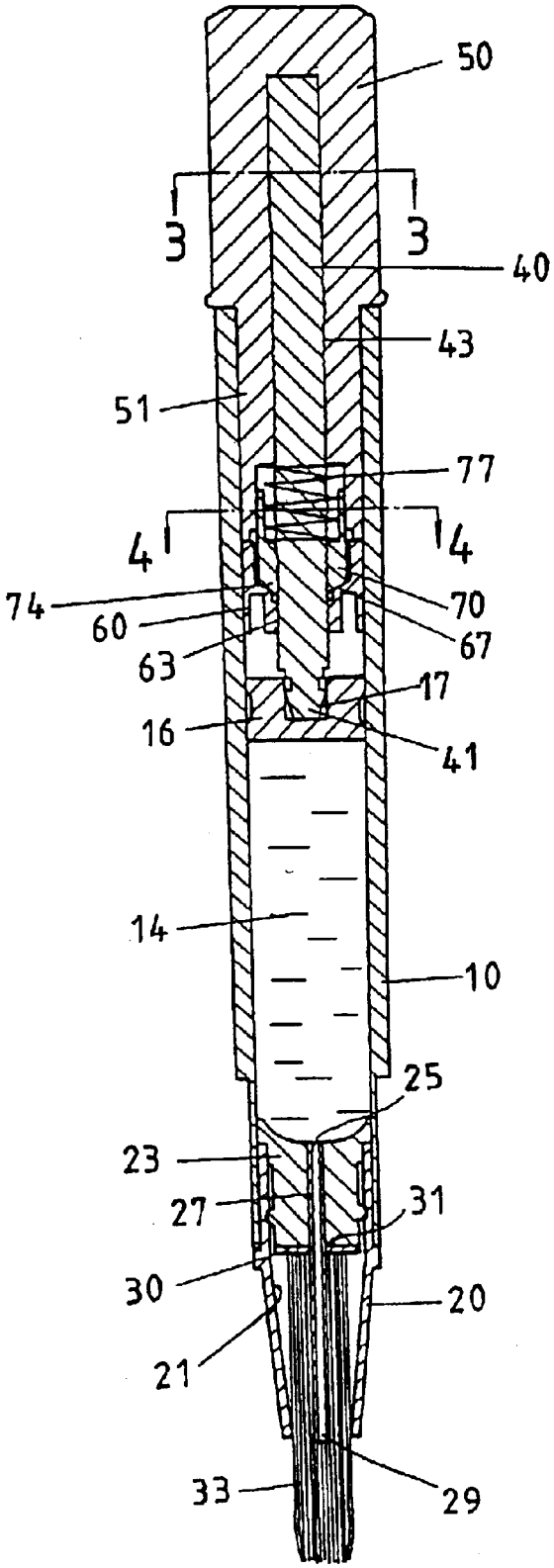
FIG. 2 is a cross sectional view taken along lines 2—2 of FIG. 3.
Figure 3:
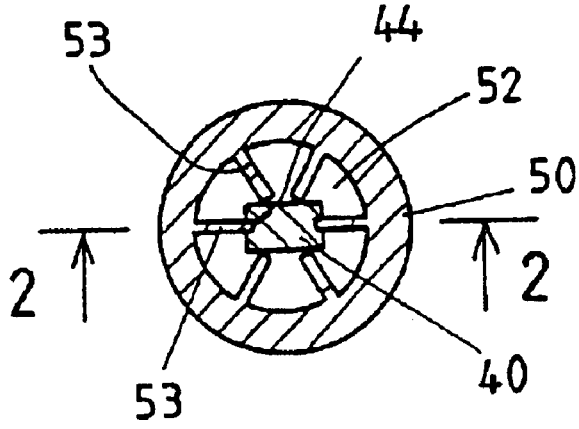
FIGS. 3, 4 are cross sectional views taken along lines 3—3 and 4—4 of FIG. 2 respectively.
Figure 4:
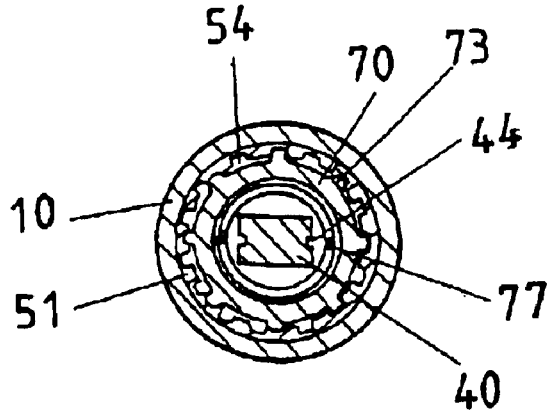
Figure 5:
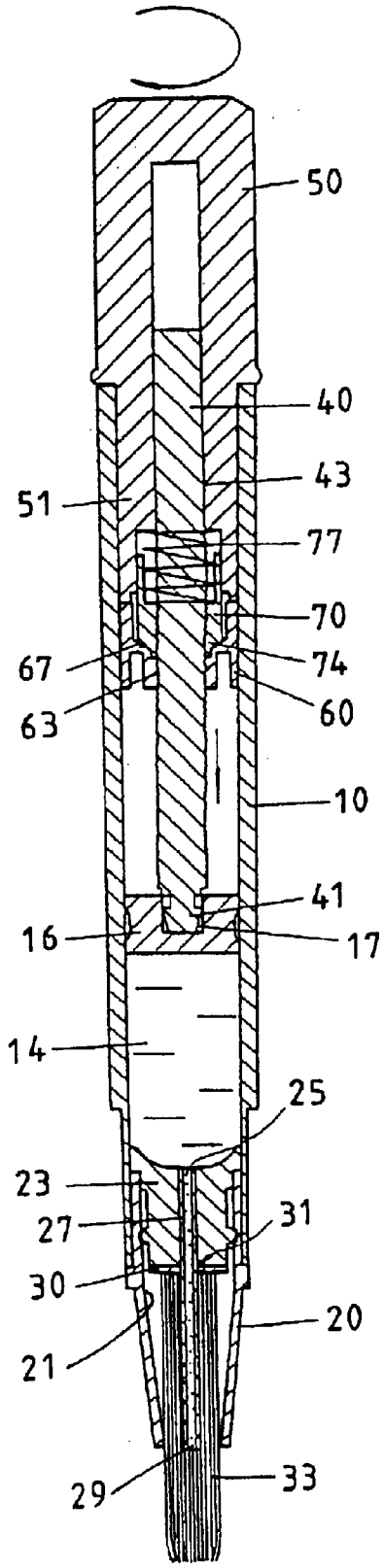
FIG. 5 is a cross sectional view similar to FIG. 2, illustrating the operation of the liquid lipstick dispensing device.

As best shown in FIGS. 2 and 5, the tube 27 is not fully or completely extended out through the brush member 33, but, includes a free end 29 engaged within the brush member 33, such that the liquid-state, or pasty-like lipstick material 14 flown out through the tube 27 may flow into the brush member 33, and may thus be contained within the brush member 33, and may thus be suitably applied onto the users.

Alternatively, the mouths 22, 26 may include the plate 24 directly secured thereon, and may include the orifice 25 formed in the plate 24, and may include a spongy material or perforated member 28 attached to the free end thereof, to absorb and to dispense the liquid-state, or pasty-like lipstick material. A cover 18 may be attached to the bottom portion of the housing 10, to shield the mouth 20 and the brush member 33.

A shank 40 is received in the housing 10, and includes a lower protrusion 41 engaged into the cavity 17 of the piston 16, and secured to the piston 16 by such as force-fitted engagements, latches, adhesive materials, or by welding processes, such that the piston 16 may be moved along the housing 10 by the shank 40, to force the liquid-state, or pasty-like lipstick material 14 out of the housing 10.

The shank 40 includes an outer thread 43 formed on the outer peripheral portion thereof, and includes one or more slots 44 formed in the outer peripheral portion thereof. A barrel 50 includes a conduit 51 of a reduced outer diameter and rotatably engaged in the chamber 11 of the housing 10, and includes a bore 52 formed therein to receive the shank 40.

The barrel 50 further includes one or more ribs 53 extended into the bore 52 thereof, and having one or more of the ribs 53 engaged into the slots 44 of the shank 40, to secure the shank 40 to the barrel 50, and for allowing the shank 40 to be rotated relative to the housing 10 by the barrel 50. The barrel 50 includes one or more protrusions or grooves 54 formed in the lower and inner portion thereof.

A duct 60 includes one or more depressions or protrusions 61 provided on the outer peripheral portion thereof, to engage with the corresponding protrusions or depressions 12 of the housing 10, with such as force-fitted engagements, latches, adhesive materials, or by welding processes, such that the duct 60 may be secured within the housing 10 and will not be moved or rotated relative to the housing 10.

The duct 60 includes an inner thread 63 formed therein to engage with the outer thread 43 of the shank 40, and to move the shank 40 longitudinally along the housing 10 when the shank 40 is rotated relative to the duct 60 and the housing 10 with the barrel 50, and thus for moving or forcing the liquid-state, or pasty-like lipstick material 14 out of the housing 10.

The duct 60 includes an enlarged space 64 formed therein to form an inner peripheral shoulder 65 therein, and includes one or more cusps or swellings 67 extended from the inner peripheral shoulder 65 thereof.

A sleeve 70 includes a bore 71 formed therein to slidably or rotatably receive the shank 40, and includes one or more depressions or protrusions 73 extended or provided on the outer peripheral portion thereof, to engage with the corresponding protrusions or grooves 54 of the barrel 50, with such as force-fitted engagements, latches, adhesive materials, or by welding processes, such that the sleeve 70 may be secured to the barrel 50 and rotated in concert with the barrel 50.

The sleeve 70 includes one or more projections or ratchet teeth 74 extended downwardly therefrom, for engaging with the swellings 67 of the duct 60, and for preventing the barrel 50 from being rotated reversely relative to the housing 10. A spring 77 may be engaged between the sleeve 70 and the barrel 50, to force or bias the projections or ratchet teeth 74 of the sleeve 70 to engage with the swellings 67 of the duct 60.

In operation, as shown in FIGS. 2 and 5, when the shank 40 is rotated relative to the housing 10 and the duct 60 by the barrel 50, the shank 40 may be forced to move longitudinally along the housing 10, and the shank 40 may thus be used to force the piston 16 against the liquid-state, or pasty-like lipstick material 14, in order to move or force the liquid-state, or pasty-like lipstick material 16 out through either of the mouths 20, 22, 26, and for allowing the liquid-state, or pasty-like lipstick material 14 to be engaged into the spongy material or perforated member 28 or the brush member 33 and to be applied onto the users.

The mouths 20, 22, 26 may be alternatively or selectively or detachably attached to the housing 10, according to the users need, for allowing the liquid-state, or pasty-like lipstick material 14 to be engaged into either the spongy material or perforated member 28 or the brush member 33 of the mouths 20, 22, 26.

The engagement of the ratchet teeth 74 of the sleeve 70 with the swellings 67 of the duct 60 may be used for preventing the barrel 50 from being rotated reversely relative to the housing 10, and may thus be used to prevent the air from being drawn into the chamber 11 of the housing 10.

Accordingly, the liquid lipstick dispensing device in accordance with the present invention may be used or provided for evenly dispensing the liquid-state or pasty-like lipstick.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A liquid lipstick dispensing device comprising:

a housing including a chamber formed therein to receive lipstick material therein, and including a lower portion and an upper portion, a mouth attached to said lower portion of said housing, to receive said lipstick material and to allow said lipstick material to flow out of said housing via said mouth, a piston slidably received in said chamber of said housing and engaged with said lipstick material, to force said lipstick material to flow out of said housing, a shank including a first end attached to said piston, to move said piston relative to said housing and against said lipstick material, said shank including an outer portion having an outer thread formed thereon, a duct disposed in said housing, and including an inner thread formed therein and engaged with said outer thread of said shank, to cause said shank to move longitudinally along said housing when said shank is rotated relative to said duct and said housing, a barrel secured to said shank, to rotate said shank relative to said duct and said housing, reverse rotation preventing means for preventing said barrel from being rotated reversely relative to said housing, said reverse rotation preventing means including a plurality of swellings provided in said duct, and a sleeve attached to said barrel and having at least one tooth engageable with said swellings of said duct, to prevent said barrel from being rotated reversely relative to said housing, and means for biasing said at least one tooth of said sleeve to engage with said swellings of said duct, and to prevent said barrel from being rotated reversely relative to said housing.

2. The liquid lipstick dispensing device as claimed in claim 1, wherein said mouth includes an upper end having a plate attached thereto, said plate includes an orifice formed therein to allow said lipstick material to flow into said mouth and thus to flow out of said housing via said mouth.

3. The liquid lipstick dispensing device as claimed in claim 2, wherein said mouth further includes a lid secured to said plate and received in said mouth.

4. The liquid lipstick dispensing device as claimed in claim 2, wherein said mouth includes a tube secured to said plate and received in said mouth, to define said orifice of said plate.

5. The liquid lipstick dispensing device as claimed in claim 4, wherein said mouth further includes a brush device disposed therein, and having a brush member extended out of said mouth.

6. The liquid lipstick dispensing device as claimed in claim 5, wherein said brush device includes a panel received in said mouth, and having an aperture formed therein to receive said tube.

7. The liquid lipstick dispensing device as claimed in claim 5, wherein said tube includes a free end engaged within said brush member.

8. The liquid lipstick dispensing device as claimed in claim 1, wherein said housing includes a plurality of depressions formed therein, said duct includes an outer peripheral portion having at least one protrusion extended therefrom, to engage into either of said depressions of said housing, to prevent said duct from being rotated relative to said housing.

9. The liquid lipstick dispensing device as claimed in claim 1, wherein said shank includes at least one slot formed therein, said barrel includes at least one rib extended therefrom, and engaged into said at least one slot of said shank, to secure said shank to said barrel, and to allow said shank to be rotated in concert with said barrel.

10. The liquid lipstick dispensing device as claimed in claim 1, wherein said duct includes an inner peripheral shoulder formed therein, and said swellings are extended from said inner peripheral shoulder of said duct.

11. The liquid lipstick dispensing device as claimed in claim 1, wherein said barrel includes a plurality of grooves formed therein, and said sleeve includes an outer peripheral portion having at least one protrusion extended therefrom and engaged with either of said grooves of said barrel, to prevent said sleeve from rotating relative to said barrel.

* * * * *